United States Patent [19]

Berkel, Jr.

[11] 4,135,632

[45] Jan. 23, 1979

[54] LOAD INDICATORS FOR CONSTRUCTION VEHICLES

[75] Inventor: James A. Berkel, Jr., Edelstein, Ill.

[73] Assignee: Caterpillar Tractor Co., Peoria, Ill.

[21] Appl. No.: 791,904

[22] Filed: Apr. 28, 1977

[51] Int. Cl.[2] ..... E02F 9/26

[52] U.S. Cl. ..... 214/761; 37/DIG. 19; 212/39 MS; 340/685

[58] Field of Search ..... 214/761, 762; 212/39 R, 212/39 A, 39 P, 39 MS, 35 HC; 340/267 C; 37/DIG. 19; 74/569

[56] References Cited

U.S. PATENT DOCUMENTS

| | | | |
|---|---|---|---|
| 2,030,529 | 2/1936 | Nash | 340/267 C X |
| 3,035,712 | 5/1962 | Nowack | 212/39 MS |
| 3,061,117 | 10/1962 | Kruse | 214/761 X |
| 3,105,603 | 10/1963 | Beyerstedt et al. | 214/762 |
| 3,123,814 | 3/1964 | Aitken | 340/267 C |
| 3,141,562 | 7/1964 | McAdams | 212/39 A X |
| 3,149,592 | 9/1964 | Casas-Robert | 74/569 X |
| 3,275,174 | 9/1966 | Konefes | 214/761 |
| 3,489,294 | 1/1970 | Greb et al. | 212/55 X |
| 3,724,679 | 4/1973 | Brownell et al. | 212/39 MS |

FOREIGN PATENT DOCUMENTS

| | | | |
|---|---|---|---|
| 828138 | 2/1960 | United Kingdom | 212/35 HC |

*Primary Examiner*—L. J. Paperner
*Attorney, Agent, or Firm*—Phillips, Moore, Weissenberger, Lempio & Majestic

[57] ABSTRACT

A loader comprises a pair of lift arms pivotally mounted on a forward end of a frame thereof. A double-acting hydraulic cylinder is interconnected between the frame and each lift arm to move the lift arms between lowered and raised positions. A loader bucket is pivotally mounted on a forward end of the lift arms and a gauge is provided to indicate the magnitude of load retained in the bucket. A valve is connected to the cylinder to receive a pressure signal therefrom which is communicated to the gauge upon opening of the valve. A control means, including a cam attached to one lift arm for movement therewith, sequentially (1) initially applies a closing force to the valve when the lift arms are in their lowered positions, (2) permits the valve to open to communicate the pressure signal to the gauge when the lift arms are moved to a predetermined height above ground level, and (3) maintains the valve in its same open condition to continue communication of the pressure signal to the gauge when the lift arms are further moved towards their raised positions.

16 Claims, 4 Drawing Figures

LOAD INDICATORS FOR CONSTRUCTION VEHICLES

BACKGROUND OF THE INVENTION

A conventional loader comprises a pair of lift arms having a loader bucket mounted on forward ends thereof. A double-acting hydraulic cylinder is operatively connected to each lift arm to selectively raise or lower the same. When the bucket is filled, it has proven desirable to alert the operator as to the magnitude of load retained in the bucket for transfer to a truck or like hauling vehicle. It has proven desirable to employ an indicating device in conjunction with movement of the bucket or lift arms to indicate to the operator the magnitude of load imposed thereon.

The indicating device functions in response to loads carried by the bucket, but does not provide means for overriding the functioning thereof under certain work conditions wherein the indicating feature is not required. For example, such indicating feature is not required when the bucket is lowered to its ground-engaging, digging or loading position whereby high break-out and loading forces are imposed thereon. Also, the indicated load will oftentimes vary when the lift arms are moved, although the actual load remains the same.

SUMMARY OF THIS INVENTION

The present invention is directed to overcoming one or more of the problems as set forth above.

The construction vehicle of this invention, such as a loader, comprises a member movably mounted thereon and at least one fluid actuated cylinder operatively connected to the member for moving it between lowered and raised positions. A work tool is mounted on the member and indicating means are provided to indicate the load imposed on the member by the work tool.

The indicating means comprises valve means operatively connected to the cylinder for receiving pressurized fluid therefrom to create a pressure signal and signal means operatively connected to the valve means for receiving the pressure signal therefrom upon opening of the valve means. A control means, responsive to movements of the member mounted on the vehicle, functions to sequentially (1) initially apply a predetermined closing force to the valve means when the member is in its lowered position, (2) permit the valve means to open to communicate the pressure signal at a level determined by the load to the signal means when the member is moved to a predetermined height between its lowered and raised positions, and (3) maintain the valve means in such open condition to continue communication of the pressure same level of the signal to the signal means when the member is further moved towards its raised position so that the signal means shows a generally constant load when the member is above the predetermined height.

BRIEF DESCRIPTION OF THE DRAWINGS

Other objects of this invention will become apparent from the following description and accompanying drawings wherein.

DETAILED DESCRIPTION

Figure 1:
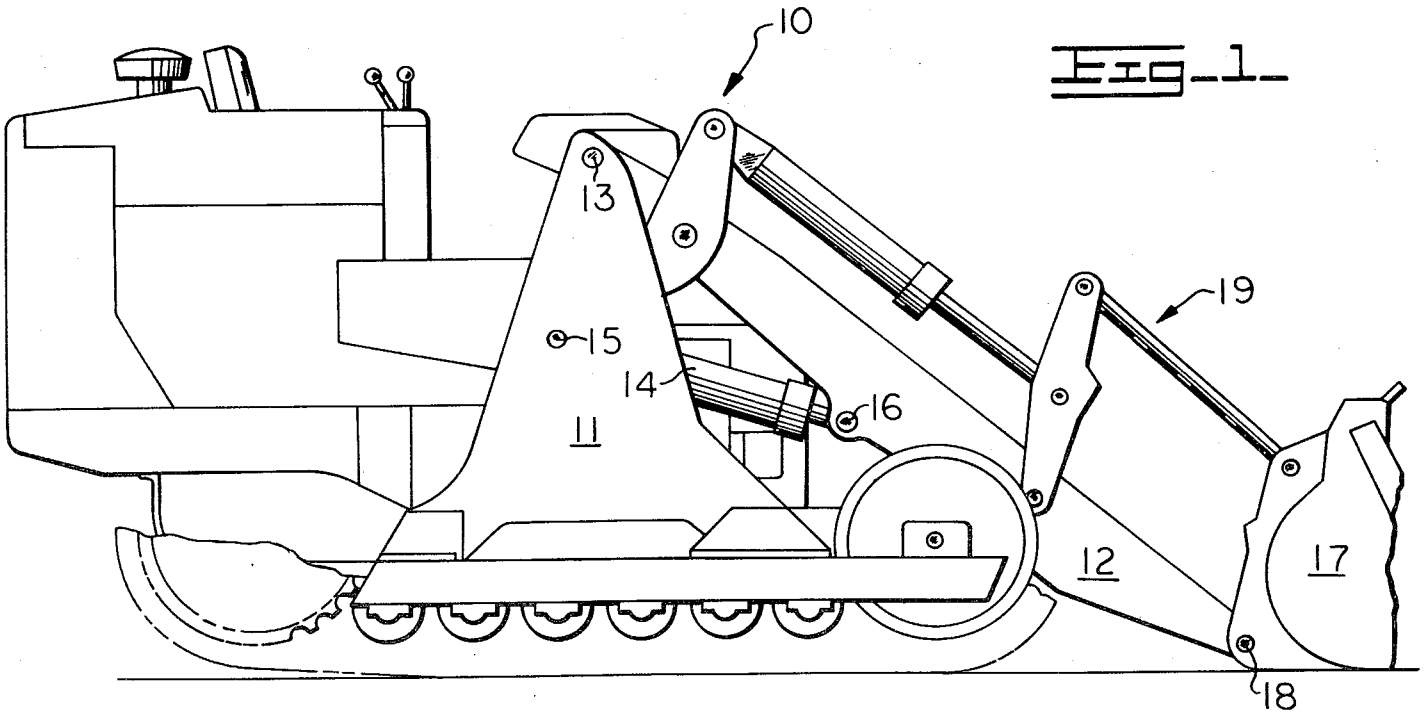
FIG. 1 is a side elevational view of a track-type loader employing the load indicating and control means of this invention thereon.

FIG. 1 illustrates a track-type loader 10 comprising a pair of upstanding brackets 11 (one shown) suitably secured to a frame thereof. A pair of lift arms 12 (one shown) each has its rearward end pivotally mounted on a respective bracket by a pin 13. A double-acting hydraulic cylinder 14 is pivotally mounted on the bracket by a pin 15 and to a respective lift arm by a pin 16 for selectively moving the lift arm between its illustrated lowered ground-engaging position and its raised or carry position.

Figure 2:
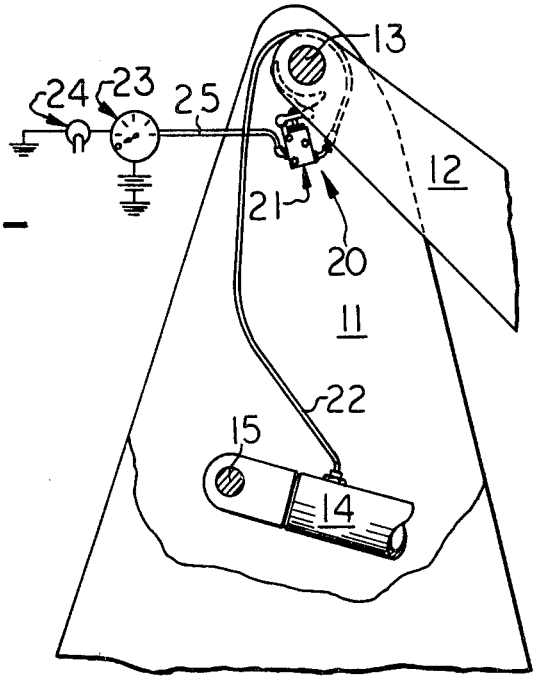
FIG. 2 is a partially schematic view of the indicating and control means in association with a lift arm and a lift cylinder of the loader.

A loader bucket 17 is pivotally mounted on a forward end of each lift arm by a pin 18 and is adapted to be selectively moved thereon by a standard tilt linkage 19. Referring to FIG. 2, an indicating means 20 of this invention is operatively associated with lift arm 12 for indicating the magnitude of load retained in bucket 17 when the lift arms are raised. It should be understood that although the invention described herein is specifically described in conjunction with a loader, that such invention could likewise be employed in association with movable members of other types of construction vehicles, such as the boom of an excavator, and with other types of work tools mounted on such member.

The indicating means comprises a valve means 21 operatively connected to cylinder 14 by a conduit 22 to receive pressurized fluid or a pressure signal therefrom. A signal means, such as illustrated pressure gauge 23 which may have an electrically actuated light or buzzer 24 associated therewith, is operatively connected to the valve means via a conduit 25 for receiving the pressure signal therefrom upon opening thereof.

A control means, comprising an actuated means or lever 26 and a cam means or plate cam 27, is adapted to apply a variable closing force to the valve means. As will be hereinafter more fully understood, the control means is responsive to movements of lift arm 12 between its lowered and raised positions for sequentially (1) initially applying a predetermined closing force to the valve means when the lift arm is in its lowered position, (2) permitting the valve means to open to communicate the pressure signal from cylinder 14 to gauge 23 when the lift arm is moved to a predetermined height between its lowered and raised positions, and (3) maintaining the valve means in its same open condition to continue communication of the same pressure signal to the gauge when the lift arm is further moved towards its raised position.

Valve means 21 comprises a housing 28 secured to bracket 11 and having a spool 29 reciprocally mounted therein. A first compression coil spring or spring means 30 is disposed between the spool and a ball 31 of a first check valve means to urge the ball to a closed position against a semi-spherical seat 32, defined in the housing. A second check valve means is in parallel relationship relative to the first check valve means and comprises a ball 33 normally biased to a closed position on a semi-spherical seat 34 by a second compression coil spring 35 and fluid pressure prevalent in conduit 22 which communicates with cylinder 14.

As will be hereinafter more fully described, when the level of fluid pressure in conduit 22 exceeds a predetermined maximum level and depending upon the rotary position of cam 27, the closing force of spring 30 will be overcome. A pressurized fluid signal will then be communicated from an inlet passage 36, past ball 31 and into an outlet passage 37 which communicates with conduit 25 communicating with pressure gauge 23. A branch passage 38 communicates with passage 37 to depressurize the gauge to allow it to return to a zero setting upon opening of ball 33 against relatively "light" spring 35 and when fluid pressure in conduit 22 is reduced to a predetermined level.

An upper end 39 of valve spool 29 engages a head end of an abutment means, preferably in the form of a set screw 40 threadably mounted in lever 26. The set screw thus provides adjustment means between the valve spool and lever for presetting the closing force on spring 30. Tightening of a lock nut 41, threadably mounted on the opposite end of the set screw, will lock the set screw in its preset axial position. A first end of the lever is pivotally mounted on housing 28 by a pin 42 whereas a second, opposite end thereof has a roller or cam follower 43 rotatably mounted thereon.

The roller engages a periphery of cam 27 which is suitably secured to lift arm 12 for rotation about a coincident pivotal axis X thereof. The cam functions to move set screw 40 against upper end 39 of spool 29 to vary the closing force on spring 30 and the opening force on ball 31 upon rotation of the cam about pivotal axis X. The cam sequentially comprises first, second and third cam portions 44, 45 and 46, respectively, for purposes hereinafter explained. Portion 44 of the cam is disposed at a maximum radii, portion 45 is disposed at a minimum radii and portion 46 is disposed at gradually increased radii, all throughout their respective circumferential lengths.

In operation, when lift arms 12 are maintained in their lowered position during the normal loading range of the loader, e.g., approximately 180 mm to approximately 800 mm above ground level as measured from pivot pin 18 (FIG. 1), substantial loading and/or break-out forces will be imposed on the bucket during loading thereof. During such a condition of operation, it proves desirable to prevent communication of the fluid pressure signal to gauge 23 via valve means 21. This overriding of the valve means and the pressure gauge is achieved by maintaining cam portion 44 in contact with roller 43 to exert a maximum closing force on spring 30, via lever 26, to maintain ball 31 in a closed position on seat 32.

Figure 4:
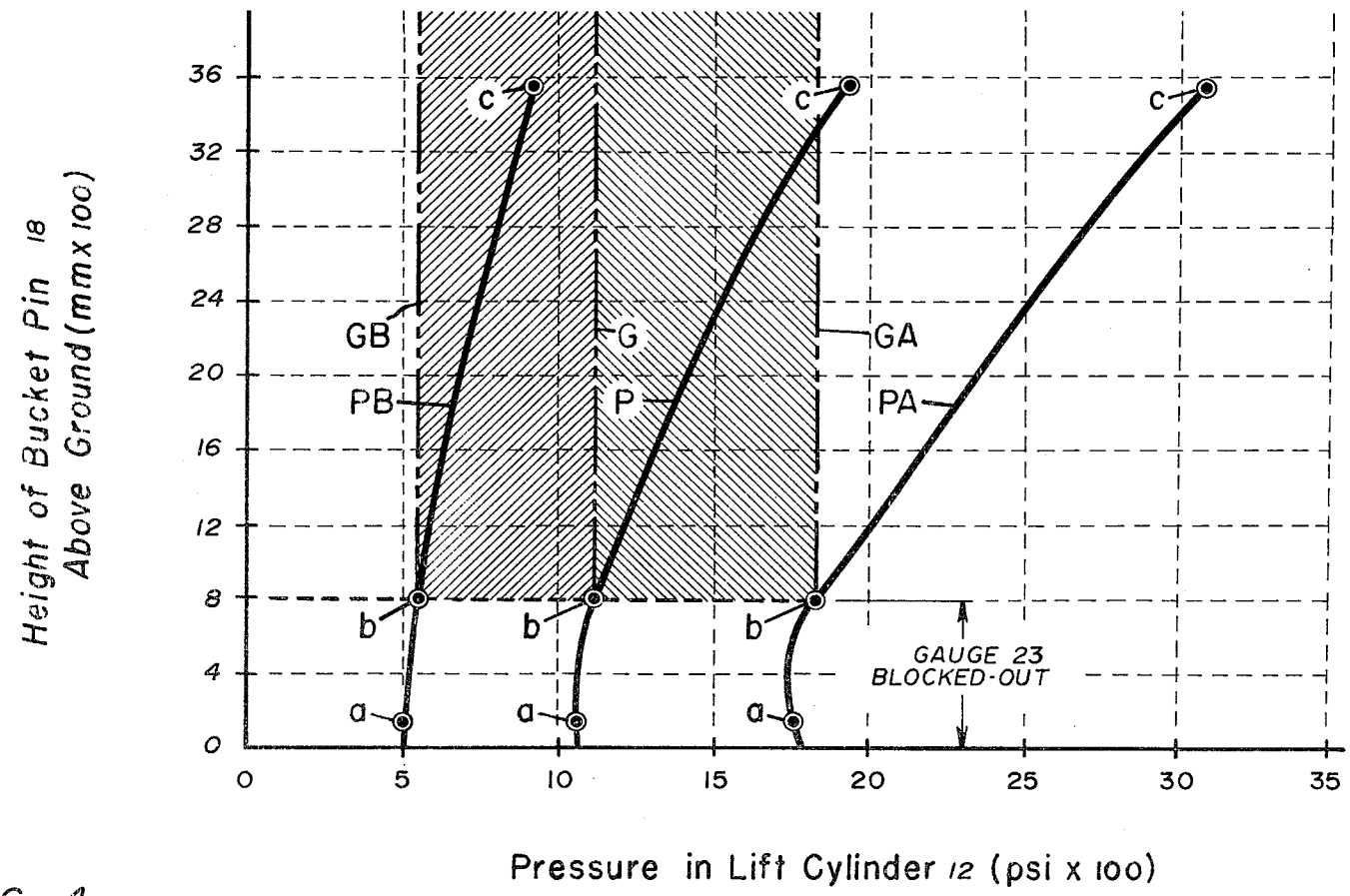
FIG. 4 graphically plots fluid pressure in the lift cylinder versus the height of a bucket employed on the loader for three typical conditions of operation.

FIG. 4 graphically illustrates the level of fluid pressure in lift cylinder 14 versus the height of pin 18 above ground level. As suggested above, it may be assumed for discussion purposes that when the bucket is resting on the ground that the height of the bucket (the vertical distance between pin 18 and the ground) approximates 180 mm. The graph illustrates three typical lift cylinder pressures P, PA and PB for various bucket loading conditions of operation.

For example, for a particular bucket load of a particular loader, a known lift cylinder pressure level P is required to raise the load to a certain, predetermined height. This pressure can be established as the base line to indicate to the operator if he has obtained a load of predetermined magnitude in the bucket to help him determine and control the load that is transferred to a truck or other conveying vehicle. Pressure curves PA and PB depict cylinder pressure levels which are above and below such base line pressure level, respectively.

For example, let it be assumed that 2,500 lbs. is established as a 100% load in the bucket and a base from which the operator can determine and control the load which is transferred to the truck. As depicted by pressure curve P, a pressure approximating 1,200 psi is required to lift 2,500 lbs. to a bucket height of 800 mm. As further depicted by curve PA, a cylinder pressure approximating 1,825 psi is required to lift a 5,000 lbs. load, which is 200% of the established load, to a bucket height of 800 mm. When the bucket assumes a 2,000 lb. load or one which is approximately 20% below the established load of 2,500 lbs., a cylinder pressure apprximating 550 psi is required to lift the load to a height of 800 mm.

Figure 3:
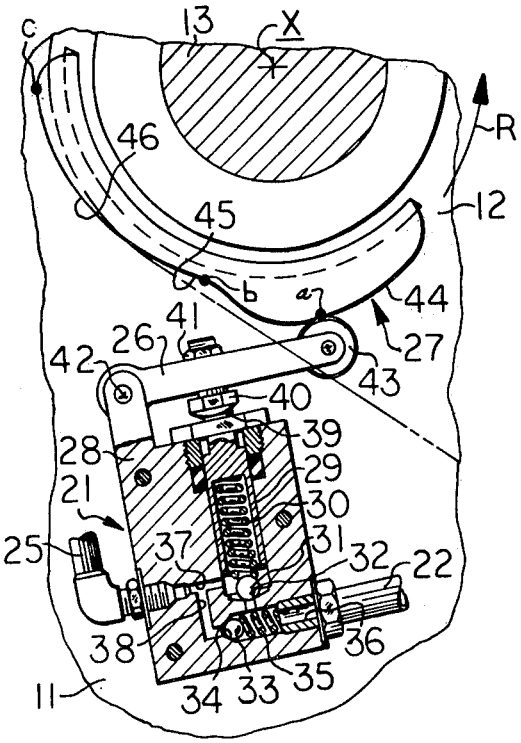
FIG. 3 is an enlarged and partially sectioned view of the indicating and control means.

Upon raising of the bucket to a height of 800 mm, gauge 23 will visually indicate the percentage, or if desired the pounds, of the load above or below the known load. Light or buzzer 24 can be utilized to alert the operator that the load is above and/or below the known load. With the bucket maintained at ground level, roller 43 will rest against raised cam portion 44, as illustrated in FIG. 3. Since this cam portion constitutes the maximum radius of the cam, spring 30 will be compressed to a maximum amount to prevent unseating of ball 31. Point a on the cam is depicted on each of the three pressure curves P, PA and PB.

Upon counterclockwise rotation of the lift arm and cam about rotational axis X and in the direction of arrow R, roller 43 will engage cam portion 45 at point b to initiate the corresponding functions illustrated at points b on the three pressure curves. At these points, the compression on spring 30 is reduced automatically to permit ball 31 to open on seat 32, in response to the pressure level prevalent in cylinder 14. A pressure signal will then be communicated to gauge 23 to provide the operator with a visual signal means indicating the percentage or pounds above or below a predetermined weight in the bucket. As further shown by the pressure curves, the pressure level prevalent in the lift cylinder will gradually increase regardless of the load retained in the bucket as the lift arms are raised.

In order to compensate for such variable pressure and to provide the operator with the same gauge reading as was registered intially at point b on the cam and its corresponding points b on the graph for a given load at the assumed bucket height of 800 mm, further counterclockwise movement of the lift arms and cam about axis X will engage roller 43 on cam portion 46 which has gradually increased radii. This cam portion will thus compensate for the rise in lift cylinder pressure by compressing and increasing the force imposed on spring 30 to prevent ball 31 from leaving seat 32. The gauge reading will thus remain unchanged from its initial position even though the lift arms are moved further upwardly to their fully raised positions. These constant gauge readings are represented on the graph by vertically disposed lines G, GA and GB.

The embodiments of the invention in which an exclusive property or privilege is claimed are defined as follows:

1. In a construction vehicle of the type having a member movably mounted thereon, at least one fluid actuating cylinder operatively connected to said member for moving it between lowered and raised positions, a work tool mounted on said member and indicating means for indicating the mode imposed on said member by said work tool, the invention wherein said indicating means comprises valve means operatively connected to said cylinder for receiving pressurized fluid therefrom to provide a pressure signal and signal means operatively connected to said valve means for receiving said pressure signal therefrom upon opening of said valve means, and control means responsive to movements of said member for sequentially (1) initially applying a predetermined closing force to said valve means when said member is in its lowered position, (2) permitting said valve means to open to communicate said pressure signal at a level determined by said load to said signal means when said member is moved to a predetermined height between its lowered and raised positions, and (3) maintaining said valve means in its same open condition to continue communication of the same level of said pressure signal to said signal means when said member is further moved towards its raised position, so that said signal means shows a generally constant load when said member is above said predetermined height.

2. The vehicle of claim 1 wherein said member constitutes a lift arm and said work tool constitutes a loader bucket pivotally mounted on a forward end of said lift arm and further comprising tilt linkage means operatively interconnected between said lift arm and said bucket for selectively pivoting said bucket on said lift arm.

3. The vehicle of claim 1 wherein said signal means comprises a pressure gauge.

4. The vehicle of claim 1 wherein said valve means comprises a housing having a spool reciprocally mounted therein and spring means disposed in said housing to have a first end thereof engage said spool for biasing said spool into engagement with said control means.

5. The vehicle of claim 4 wherein said valve means further comprises first check valve means comprising a ball engaging a second end of said spring means for biasing said ball into normal eng gement with a seat defined in said housing.

6. The vehicle of claim 5 further comprising means defining an inlet passage and an outlet passage in said housing, said ball normally blocking communication of fluid from said inlet passage to said outlet passage, said inlet passage communicating said pressurized fluid from said cylinder to said ball directly to open the same against the closing force of said spring means when said predetermined fluid pressure level is exceeded and said outlet passage communicates with said signal means.

7. The vehicle of claim 4 wherein said control means comprises actuating means including a lever pivotally mounted on said housing.

8. The vehicle of claim 7 wherein a first end of said lever is pivotally mounted on said housing and a roller is rotatably mounted on a second end of said lever, said roller engaging said cam means.

9. The vehicle of claim 8 wherein said actuating means further comprises abutment means mounted on said lever between the first and second ends thereof, said abutment means engaging an end of said spool.

10. The vehicle of claim 9 wherein said abutment means is adjustably mounted on said lever for selectively adjusting the preload on said spring means.

11. The vehicle of claim 1 wherein said valve means comprises a normally closed first check valve means for opening in response to said predetermined pressure level to communicate pressurized fluid to said signal means.

12. The vehicle of claim 1 wherein said control means comprises a plate cam attached on said member and having a rotational axis coincident with a pivotal axis of said member.

13. The vehicle of claim 12 wherein the periphery of said plate cam sequentially comprises a first cam portion having radii throughout its entire circumferential length which are greater than the radii of the remaining cam portions to initially apply said predetermined closing force to said valve means, a second cam portion having radii throughout its entire circumferential length which are less than the radii of the remaining cam portions to open said valve means and a third cam portion having gradually increased radii throughout its entire circumferential length to maintain said valve means in its said said open condition.

14. The vehicle of claim 1 wherein said control means imposes a variable opening force on said valve means to permit communication of pressurized fluid from said cylinder to said signal means as a function of raising of said member and work tool at least in general accordance with FIG. 4.

15. In a construction vehicle of the type having a member movably mounted thereon, at least one fluid actuated cylinder operatively connected to said member for moving it between lowered and raised positions, a work tool mounted on said member and indicating means for indicating the mode imposed on said member by said work tool, the invention wherein said indicating means comprises valve means operatively connected to said cylinder for receiving pressurized fluid therefrom to provide a pressure signal and signal means operatively connected to said valve means for receiving said pressure signal therefrom upon opening of said valve means, and control means responsive to movements of said member for sequentially (1) initially applying a predetermined closing force to said valve means when said member is in its lowered position, (2) permitting said valve means to open to communicate said pressure signal at a level determined by said load to said signal means when said member is moved to a predetermined height between its lowered and raised positions, and (3) maintaining said valve means in its same open condition to continue communication of the same level of said pressure signal to said signal means when said member is further moved towards its raised position; said valve means comprising a housing having a spool reciprocally mounted therein and spring means disposed in said housing to have a first end thereof engage said spool for biasing said spool into engagement with said control means, and first check valve means comprising a ball engaging a second end of said spring means for biasing said ball into normal engagement with a seat defined in said housing, and including:

means defining an inlet passage and an outlet passage in said housing, said ball normally blocking communication of fluid from said inlet passage to said outlet passage, said inlet passage communicating said pressurized fluid from said cylinder to said ball directly to open the same against the closing force of said spring means when said predetermined fluid pressure level is exceeded and said outlet passage communicates with said signal means; and second check valve means interconnected between said inlet passage and said outlet passage in parallel relationship relative to said first check valve means for communicating pressurized fluid from said signal means and outlet passage to said inlet passage directly.

16. In a construction vehicle of the type having a member movably mounted thereon, at least one fluid actuated cylinder operatively connected to said member for moving it between lowered and raised positions, a work tool mounted on said member and indicating means for indicating the load imposed on said member by said work tool, the invention wherein said indicating means comprises valve means operatively connected to said cylinder for receiving pressurized fluid therefrom to provide a pressure signal and signal means operatively connected to said valve means for receiving said pressure signal therefrom upon opening of said valve means, and control means responsive to movements of said member for sequentially (1) initially applying a predetermined closing force to said valve means when said member is in its lowered position, (2) permitting said valve means to open to communicate said pressure signal at a level determined by said load to said signal means when said member is moved to a predetermined height between its lowered and raised positions, and (3) maintaining said valve means in its same open condition to continue communication of the same level of said pressure signal to said signal means when said member is further moved towards its raised position, said valve means comprising a normally closed first check valve means for opening in response to said predetermined pressure level to communicate pressurized fluid to said signal means and normally closed second check valve means in parallel relationship relative to said first check valve means for communicating pressurized fluid from said signal means to said cylinder directly.

* * * * *